United States Patent [19]

Rees et al.

[11] 3,930,772

[45] Jan. 6, 1976

[54] MANUFACTURE OF CONJUGATE FILAMENTS

[75] Inventors: David Anthony Rees; Desmond Alfred Price, both of Pontypool, England

[73] Assignee: Imperial Chemical Industries Limited, London, England

[22] Filed: Apr. 2, 1974

[21] Appl. No.: 457,353

Related U.S. Application Data

[60] Division of Ser. No. 330,624, Feb. 8, 1973, abandoned, which is a continuation of Ser. No. 146,057, May 24, 1971, abandoned.

[30] Foreign Application Priority Data

June 1, 1970 United Kingdom ..... 26320/70

[52] U.S. Cl. ..... 425/131.5

[51] Int. Cl.[2] ..... B29C 23/00

[58] Field of Search ..... 425/131, 131.5, 463; 264/171

[56] References Cited

UNITED STATES PATENTS

| | | | |
|---|---|---|---|
| 3,457,342 | 7/1969 | Parr | 264/171 |
| 3,672,802 | 6/1972 | Matsui | 425/131 |
| 3,778,208 | 12/1973 | Bisset | 264/171 |

*Primary Examiner*—Donald G. Kelly
*Assistant Examiner*—Margaret Joyce
*Attorney, Agent, or Firm*—Cushman, Darby & Cushman

[57] ABSTRACT

Conjugate filaments containing components located in a side-by-side or eccentric sheath/core structure are formed by directing superposed layers of the polymer components across the surface of a spinneret plate into narrow channels, the channels being contained in a member integral with the spinneret plate, to form narrow streams which are extruded through extrusion orifices located below the narrow channels in a spinneret plate.

5 Claims, 4 Drawing Figures

Inventors
DAVID ANTHONY REES
DESMOND ALFRED PRICE
By
Cushman, Darby & Cushman
Attorneys

MANUFACTURE OF CONJUGATE FILAMENTS

This is a division of application Ser. No. 330,624, filed Feb. 8, 1973, now abandoned, which is a continuation of Ser. No. 146,057 filed May 24, 1971, now abandoned.

The present invention is concerned with a process and apparatus for the manufacture of conjugate filaments comprising two components which may be in a side-by-side or sheath/core relationship.

It is known to manufacture side-by-side and sheath-/core conjugate filaments by processes and apparatus such as are described in British Pat. Specification Nos. 805,033 and 830,411, in which streams of polymer are presented to an extrusion orifice for forming into filaments in the appropriate relationship. It is also known from British Pat. Specification No. 1,100,430 to produce conjugate filaments, especially those of the sheath/core type, by supplying narrow superposed layers of polymer to confined zones located behind a spinneret plate and extruding the polymers through orifices contained therein.

It is also known that the resultant positions of the components in a conjugate filament and also their cross sectional shapes can be determined by controlling the flow of one or both of the polymer components in the region surrounding the extrusion orifices.

Thus British Pat. Specification No. 1,101,452 discloses the use of baffles associated with the extrusion orifices in apparatus such as that disclosed in British Pat. Specification No. 830,441 to control the flow of streams of polymer to the extrusion orifice and thus to produce highly eccentric sheath/core filaments.

The use of baffles to control the flow of polymer in the area adjacent the extrusion orifices is also disclosed in British Pat. Specification No. 1,167,390 and also in British Pat. Specification No. 1,100,430.

In British Patent Specification No. 1,167,390 the flow of polymer is controlled by directing one polymer component along sub-channels to an extrusion orifice and injecting the second component into the polymer interface from a point above the said extrusion orifice. In this arrangement the angle subtended by the sub-channels may be varied to affect the cross sectional arrangement of the polymer components.

Similar arrangements are also disclosed in British Patent Specification No. 1,050,191 which is concerned with the production of conjugate filaments in which the components exist in a side-by-side configuration.

We have now found that conjugate filaments having a side-by-side or sheath/core configuration may be produced, by directing the flow of the polymer components, in the form of superposed layers, across portions of the surface of a spinneret plate as narrow streams that flow towards extrusion orifices, contained in the spinneret plate, in a plane perpendicular thereto and are extruded through the said orifices as conjugate filaments.

Accordingly, therefore, the present invention provides a method for the manufacture of conjugate filaments wherein superposed layers of fibre-forming polymers are formed into narrow streams that flow across the surface of a spinneret plate towards extrusion orifices contained therein in paths perpendicular to the said orifices and are extruded therethrough as conjugate filaments having a side-by-side or sheath/core configuration.

The superposed layers of polymer are preferably formed by the method described in British Patent Specification No. 1,100,430 in which the polymer components are supplied in a band-like composite stream to the periphery of a confined region bounded on one side by the spinneret plate containing the extrusion orifices, in which confined region the stream forms superposed layers of polymer which are then directed towards the extrusion orifices.

Alternatively, the superposed layers may be formed from streams of polymers in which the components are in a sheath/core relationship, which streams are directed on to the surface of the spinneret plate to form superposed layers. Such sheath/core streams may be formed by known assemblies, for example the assembly described in British Patent Specification No. 830,441 may be employed for this purpose.

When the extrusion orifices contained in the spinneret plate are located, at the extreme ends of the narrow streams, the polymers are extruded in a side-by-side configuration. However, if the streams are permitted to flow beyond the extrusion orifices, the polymers are then extruded in a sheath/core configuration.

The invention also includes conjugate filaments prepared by the above described processes.

The narrow streams of superposed layers are formed by directing the said layers of polymer into narrow channels formed in a member, to which polymer has access from all sides, located in contact with the upper surface of the spinneret plate. The extrusion orifices are located below the closed end portions of these channels.

Accordingly, therefore, from another aspect the invention provides apparatus for the production of conjugate filaments comprising a spinneret plate, a member to which polymer has access from all sides located on the upper surface of the spinneret plate and having formed therein narrow channels with closed end portions, extrusion orifices contained in the spinneret plate and positioned directly below the closed end portions of the said narrow channels and means located above and in contact with the aforesaid member to supply polymers to the upper surface of the spinneret plate in the form of superposed layers.

Preferably the aforementioned member containing the narrow channels is integral with the spinneret plate.

The extrusion orifices may be located by the extreme ends of the closed end portions of the narrow channels in which case the polymers are extruded therethrough in a side-by-side configuration, or the orifices may be located at some distance before the closed end portion of the channel in which case the polymers will be extruded in a sheath/core configuration, the nearer the location of the extrusion orifices to the closed end portion of the narrow channels the more highly eccentric the sheath/core configuration becomes.

The means for providing the polymer components in superposed layers is preferably that described in British Patent Specification No. 1,100,430 which means comprises a plate defining a confined space above the spinneret plate and permits polymers to flow as a band-like composite stream around the periphery thereof into said confined space in the form of superposed layers. The said plate being in contact with the member located on the spinneret surface.

Alternatively, the means may comprise upper and lower plates containing axially aligned orifices, the lower plate being in contact with the member located on the surface of the spinneret plate, means for supplying one polymer component between the said plate and a polymer supply means located behind the upper plate and in communication with the orifices therein to permit streams of polymer in a sheath/core configuration to be directed on to the upper surface of the spinneret plate.

The invention will now be more fully described with reference to the accompanying drawings.

Figure 1:
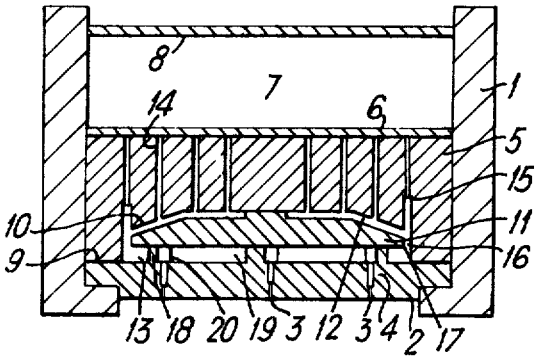
FIG. 1 is a cross section of a spinneret assembly across A–A' of FIG. 2.
Figure 2:
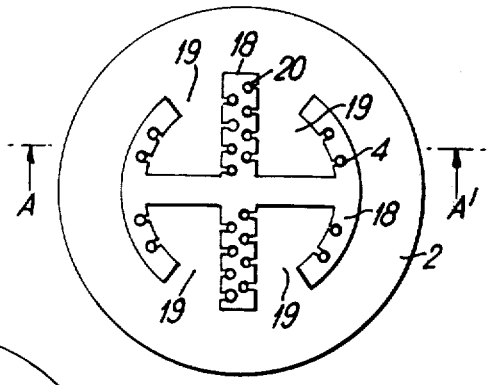
FIG. 2 is a plan view of the spinneret plate of FIG. 1.

In FIGS. 1 and 2 a pack holder 1 contains a spinneret assembly comprising a spinneret plate 2 containing orifices 3 located in the base of counter bores 4, a distributor plate 5 is mounted on the spinneret plate and a bottom screen 6 rests on top of the said distributor plate, above which is filter pack 7 and an upper screen 8. The distributor plate 5 has its lower face 9 cut away to provide a recess 10 into which a baffle plate 11 is secured. An annular space 12 is provided between the recess 10 and the upper face of the baffle plate which is shaped to conform with the contour of the lower face of the distributor plate. The depth of the baffle plate 11 is arranged to provide a confined space 13 defined by the upper surface of the spinneret plate and the lower surface of the baffle plate. The distributor plate 5 contains inner feed orifices 14 which provide communication for polymer between the bottom of the filter pack 7 and the annular region 12, and outer feed orifices 15 which provide communication for polymer between the bottom of the filter pack and the annular region 16 defined by the outer wall of the spinneret assembly and the outermost portion 17 of the baffle plate. The spinneret plate 2 contains a raised portion 18 which contacts the lower surface of the baffle plate 11 and thus breaks up the confined space 13 into four areas 19. Elongate channels 20 are formed in the raised portions 18 of the spinneret plate. The extrusion orifices counter bores 4 being so located in the spinneret plate that they are positioned below the closed end portions of the channels 20.

Figure 3:
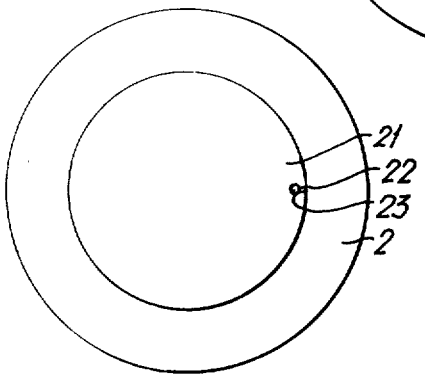
FIG. 3 is a plan view of an alternative form of spinneret plate.

In FIG. 3 the spinneret plate 2 contains a circular raised portion 21 in which elongate channels 22 are formed; extrusion orifices 23 being positioned immediately below the closed end portions of the said channels.

Figure 4:
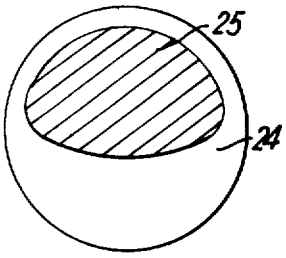
FIG. 4 is a cross section of a filament.

In FIG. 4 the filament contains a sheath portion 24 and a core portion 25.

When using the apparatus of FIGS. 1 and 2 the molten fibre-forming polymers which are to form the components of a conjugate filament are introduced into the top of the filter pack 7 through screen 8 in the form of two annular streams, the innermost stream forming a core. The polymers are forced through the filter pack and bottom screen 6 and arrive at the top of the distributor plate 5 such that only the core stream passes through the inner feed holes 14 into the annular space 12 and the outer annular stream passes down the outer feed orifices 15 into the annular region 16, where it forms a liquid interface with the core stream to reform into two annular concentric streams. The streams pass around the outermost portion 17 of the baffle plate into the confined space 13 where they form two superposed layers, the inner stream forming the upper layer. The two layers flow around the raised portion 18 of the spinneret plate into the areas 19 and thence into the elongate channels 20 where they are extruded through extrusion orifices 3 as sheath/core conjugate filaments in which the core portion 25 is located eccentrically within the sheath 24 as depicted in FIG. 4.

We claim:

1. Apparatus for the production of conjugate filaments comprising a spinneret plate having an upper surface and containing extrusion orifices formed therethrough, a member to which viscous liquid polymers have access from all sides located on the upper surface of said spinneret plate and having narrow channels formed therein, each channel extending from a side of said member in a direction substantially perpendicular to the extrusion orifices and terminating in a closed end portion, each end portion being connected to a separate extrusion orifice formed below said end portion, and means located above and in contact with said member for supplying viscous liquid polymers to the upper surface of said spinneret plate in the form of superposed layers.

2. Apparatus as in claim 1 wherein said member is integral with said spinneret plate.

3. Apparatus as in claim 1 wherein the means for supplying the polymer components as superposed layers comprises a plate in contact with said member located on the spinneret surface and defining a confined space above said spinneret plate, which plate permits the polymer components to flow as a band-like composite stream around the periphery thereof into the said confined space to form superposed layers.

4. Apparatus as in claim 1 wherein the means for supplying the polymer components as superposed layers comprises an upper and lower plate containing axially aligned orifices, the lower plate being in contact with the member on the surface of the spinneret plate, means for supplying one polymer component between the said plates and a polymer supply means located behind the upper plate and in communication with the orifices therein to permit streams of polymer in a sheath/core configuration to be directed on to the upper surface of the spinneret plate.

5. Apparatus for the production of conjugate filaments comprising a spinneret plate having an upper surface and containing extrusion orifices formed therethrough, said upper surface having a raised portion with sides and containing channels therein, and means located above and in contact with said sides for supplying two viscous liquids in the form of two superposed layers thereto, each of said channels extending from a side of the raised portion in a direction perpendicular to the extrusion orifices and terminating in a closed end portion having an extrusion orifice located therein.

* * * * *